United States Patent [19]

Colson

[11] 4,448,451

[45] May 15, 1984

[54] SELF-LOCKING SLING

[75] Inventor: Eugène J. Colson, Antwerp, Belgium

[73] Assignee: N.V. Transworld Marine Agency CY S.A., naamloze vennootschap, Antwerp, Belgium

[21] Appl. No.: 340,858

[22] Filed: Jan. 20, 1982

[30] Foreign Application Priority Data

Jan. 20, 1981 [BE] Belgium ..... 2/58962

[51] Int. Cl.[3] ..... B66C 1/18

[52] U.S. Cl. ..... 294/74

[58] Field of Search ..... 294/74, 77, 81 R, 75, 294/67 R, 67 B, 67 BA, 67 BB, 67 D, 67 DB, 67 E, 67 EA; 206/451, 453

[56] References Cited

U.S. PATENT DOCUMENTS 3,296,670 1/1967 Burnett ..... 294/74

3,829,144 8/1974 Nattrass ..... 294/74

FOREIGN PATENT DOCUMENTS 1394823 5/1975 United Kingdom .

611851 5/1976 U.S.S.R. ..... 294/74

*Primary Examiner*—James B. Marbert

*Attorney, Agent, or Firm*—Schwartz, Jeffery, Schwaab, Mack, Blumenthal & Koch

[57] ABSTRACT

Self-locking sling of the type comprising a strap folded and sewn into the shape of a clover-leaf, characterized by a second strap or ribbon, folded and sewn into a star-shaped polygon, the number of tips of which being equal to that of the loops of the clover-leaf.

3 Claims, 5 Drawing Figures

SELF-LOCKING SLING

BACKGROUND OF THE INVENTION

The present invention pertains to a self-locking sling for loading, unloading and transporting goods packed into bags or the like.

Since several years, slings are used which are constituted by a strap, thong or ribbon successively folded and bent so as to constitute a central carrying zone surrounded by a number of loops. Such slings have the shape of a three or four bladed clover-leaf.

The load, for instance a pile of filled bags, is placed on said carrying zone whereafter the loops are brought upwards around the load and are mutually connected by means of a twine. The free extremities of the loops are intended to be engaged by the hook of a crane, for instance when the load must be heaved in or out of the hold of a ship. Such a known sling holds the load together only when the latter is suspended. In other circumstances, the sling remains around the load without acting on the latter. It is therefore generally impossible to manipulate the load with other devices than a crane, for instance with a fork lift.

This is often a great disadvantage, for instance when the merchandise must be successively transported by different carrying means.

It has therefor already been proposed to use a sling system constituted by a bottom supporting sling and a top hoisting sling these two components being secured together by means allowing a relative motion between the components in one direction and restricting or preventing movement in the other direction (GB No. 1.394.823). The purpose of this known system is to obtain a self tightening effect on the load when the latter is hoisted and a locking of the system after tightening. To this end, aforesaid means consist of pairs of chain links attached to suitable parts of the bottom supporting sling. This is an expensive solution, as the slings are generally used only once (one-way). Furthermore, interconnecting said components in this fashion when building up load units is time consuming. Therefor, it has been suggested (GB No. 1.394.823) to dispense with said chain links and to simply pass loops of the top sling through loops of the bottom sling. While this allows to maintain the self-tightening feature of the system, the eminently desirable self-locking characteristic is lost.

SUMMARY OF THE INVENTION

The object of the present invention is to provide a solution to this problem.

Therefore, the invention provides for a method for self-tightening and self-lockingly interconnecting two looped parts, respectively of a bottom and of a top part of a sling made of webbing, placed respectively underneath and on top of a load, characterized in that it consists in passing the top loop part through the bottom one from between the latter and the load and in subsequently passing the top of said loop part successively twice between the legs thereof, making one full turn around one of said legs during the second passage.

The invention also pertains to a self-tightening and self-locking sling for unit loads of bagged material, suitable for working the above-mentioned method, of the type consisting of distinct bottom and top parts made of webbing, the bottom part having a known clover-leaf configuration, characterized by a single top part having a two-loops configuration, each loop of which being of such a length that, when the sling is placed on and around a unit load, it can be shaped into two sub-loops each of which still having a sufficient length to be tied to a loop of the bottom part by means of a self-locking sliding knot whilst forming a hoisting loop.

BRIEF DESCRIPTION OF THE DRAWINGS

For more clarity, one embodiment of the invention is described hereinafter more in detail, reference being made to the appended drawings, wherein.

DETAILED DESCRIPTION OF THE PREFERRED EMBODIMENTS

Figure 1:
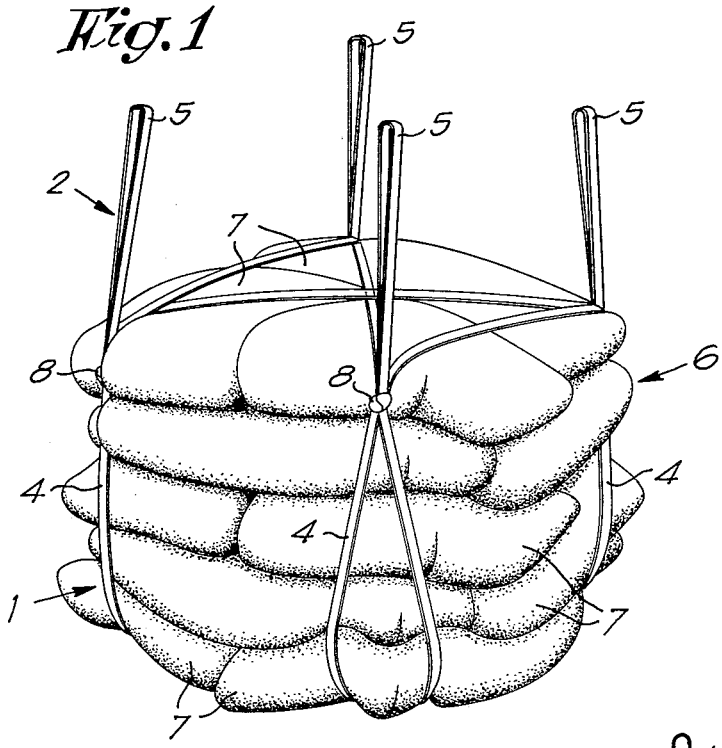
FIG. 1 shows a sling according to the invention, disposed around a load.

The illustrated sling has two components: a clover-leaf 1 known per se and a strap 2 folded and sewn into a star-shaped tetragon.

The clover-leaf 1 has a carrying zone 3 each corner of which having a loop 4.

Component 2 has four loop-shaped corners 5.

Figure 5:
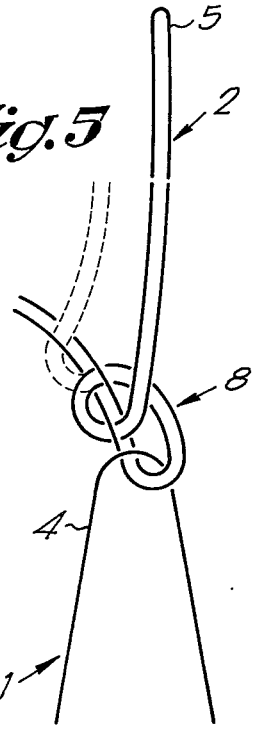
FIGS. 3–5 show how the two components of the sling are tied together, according to the method of this invention.
Figure 3:
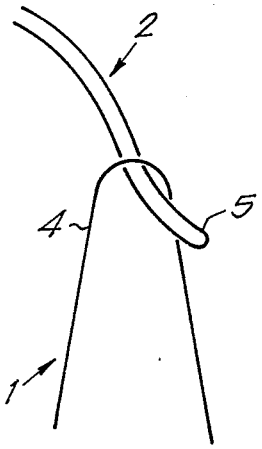
Figure 4:
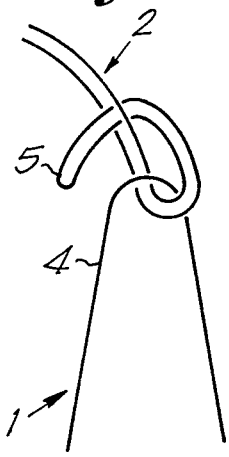
Figure 2:
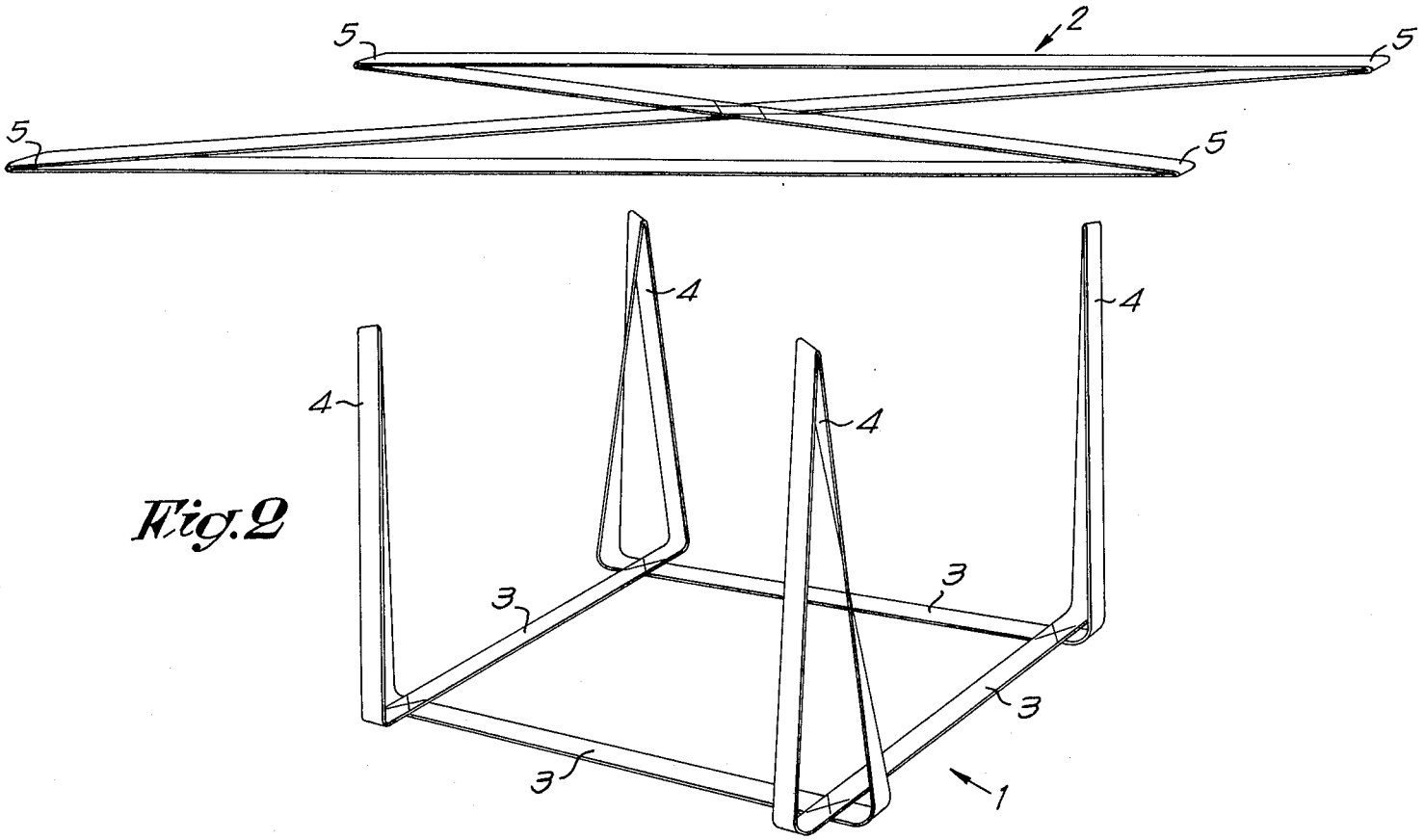
FIG. 2 is a schematical, exploded view of the sling shown in FIG. 1.

The load 6, i.e. a pile of filled bags, is disposed on the carrying zone 3, whereafter the loops 4 are raised. The length of the loops 4 is such that they do not reach the upper level of the load 6. Element 2 is placed on top of the load and each of its loops 5 is tied to a corresponding loop 4 by means of a self-locking sliding knot 8. FIGS. 3 to 5 schematically show how each knot 8 is made.

As illustrated, a top loop part is passed through a bottom loop part from between the latter and the load and, subsequently passing the top of said top loop part is successively passed twice between the legs thereof, makine one full turn around one of said legs during the second passage.

The second passage is preferably effectuated closer to the top of the load than the first as shown in dotted lines in FIG. 5.

The free ends of loops 5 are intended to be slung to the hook of a crane. When the load is then raised, the knots 8 slide so that the load is permanently compressed whereby it can later easily be transported for instance by fork-lifts and similar, to be placed in railway cars, on trucks, etc.

The invention is of course not limited to the embodiment described hereabove, considering that numerous modifications thereto may come into consideration.

What I claim is:

1. A method for self-tighteningly and self-lockingly interconnecting two loop parts, respectively of a bottom and of a top part of a sling made of webbing, placed respectively underneath and on top of a load, said method comprising:

passing the top loop part through the bottom loop part from between the bottom loop part and the load, and subsequently passing the top of said top loop part successively twice between the legs thereof, making one full turn around one of said legs during the second passage.

2. A method according to claim 1, wherein the second passage between the legs is effectuated closer to the top of the load than the first.

3. A self-tightening sling for unit loads of bagged material, comprising:

distinct bottom and top parts made of webbing, the bottom part having a clover-leaf configuration, said top part having a two-loop configuration, each loop of which being shaped into two sub-loops, when the sling is placed on and around a unit load, each of said sub-loops being tied to a loop of the bottom part by a self-locking sliding knot and including an exposed portion projecting from said knot and forming a hoisting loop, whereby four knots and four hoisting loops are formed.

* * * * *